US011059615B2

(12) United States Patent
Mößnang et al.

(10) Patent No.: US 11,059,615 B2
(45) Date of Patent: Jul. 13, 2021

(54) PACKAGING MACHINE WITH SUCTION PLATE

(71) Applicant: Multivac Sepp Haggenmüller SE & Co. KG, Wolfertschwenden (DE)

(72) Inventors: Konrad Mößnang, Kempten (DE); Nadine Reichart, Unterjoch/Bad Hindelang (DE); Markus Wägele, Lautrach (DE); Florian Lutz, Ottobeuren (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 53 days.

(21) Appl. No.: 16/555,025

(22) Filed: Aug. 29, 2019

(65) Prior Publication Data

US 2020/0071012 A1 Mar. 5, 2020

(30) Foreign Application Priority Data

Aug. 30, 2018 (DE) ..... 10 2018 214 760.4

(51) Int. Cl.

| | |
|---|---|
| ***B65B 35/18*** | (2006.01) |
| ***B65B 35/56*** | (2006.01) |
| ***B65B 57/02*** | (2006.01) |
| ***B65B 47/06*** | (2006.01) |

(52) U.S. Cl.

CPC ..... *B65B 35/18* (2013.01); *B65B 35/56* (2013.01); *B65B 47/06* (2013.01); *B65B 57/02* (2013.01); *B65B 2220/02* (2013.01)

(58) Field of Classification Search

None

See application file for complete search history.

(56) References Cited

U.S. PATENT DOCUMENTS

| | | | |
|---|---|---|---|
| 6,623,236 | B1 | 9/2003 | Barnes |
| 2014/0056684 | A1 | 2/2014 | Sydorko |
| 2015/0266602 | A1 | 9/2015 | Franceschi et al. |

(Continued)

FOREIGN PATENT DOCUMENTS

| | | | |
|---|---|---|---|
| CH | 39493 | A | 3/1908 |
| DE | 1851552 | L1 | 5/1962 |
| DE | 1295342 | B | 5/1969 |

(Continued)

*Primary Examiner* — Ronald P Jarrett

(74) *Attorney, Agent, or Firm* — Brooks Kushman P.C.

(57) ABSTRACT

A packaging machine comprising a machine frame, at least one work station attached to the machine frame, and a transport device with a transfer unit for feeding trays to the work station, wherein the transfer unit comprises a suction plate for transporting trays in a predetermined transport plane. The suction plate may comprises at least one reception mold which is formed at least in part having the shape of an inner contour of an upper opening region of a tray facing it, provided to the reception mold for reception and transport, so that the reception mold during transport in the transport plane of the tray is arranged in a positive-fit manner in its upper opening region and aligns the tray in the transport plane in a predetermined position on the suction plate. The invention also relates to a method for supplying trays to a work station of a packaging machine.

20 Claims, 8 Drawing Sheets

(56) References Cited

U.S. PATENT DOCUMENTS

| | | | | | |
|---|---|---|---|---|---|
| 2019/0247983 | A1* | 8/2019 | Borowicz | ..... | B65G 47/917 |

FOREIGN PATENT DOCUMENTS

| | | | | | |
|---|---|---|---|---|---|
| DE | 2258055 | A1 | | 7/1974 | |
| DE | 8705541 | U1 | | 7/1987 | |
| DE | 4441284 | A1 | | 5/1996 | |
| EP | 0919304 | | * | 6/1999 | ..... B21D 22/21 |
| GB | 2199559 | | * | 4/1987 | ..... B65G 59/04 |
| WO | 2013004837 | A1 | | 1/2013 | |
| WO | 2013144835 | A1 | | 10/2013 | |
| WO | 2016171561 | A1 | | 10/2016 | |
| WO | 2017001114 | A1 | | 1/2017 | |

* cited by examiner

PACKAGING MACHINE WITH SUCTION PLATE

CROSS-REFERENCE TO RELATED APPLICATIONS

This Application claims priority to German Patent Application No. 10 2018 214 760.4 filed on Aug. 30, 2018 to Konrad Mößnang, Nadine Reichart, Markus Wägele and Florian Lutz, currently pending, the entire disclosure of which is incorporated herein by reference.

FIELD OF THE INVENTION

The present invention relates to a packaging machine with a suction plate and a method for supplying trays to a workstation of a packaging machine by use of a suction plate.

BACKGROUND OF THE INVENTION

In known types of machines used in the technical field of the invention, a significant challenge is to accurately receive the trays that are fed to the machine for further processing, to transport them onward and to finally transfer them to a work station, for example, a thermoforming station of the packaging machine in a predetermined format.

Precise transfer to a thermoforming station means that thermoformed packaging trays produced therein can also be precisely combined with and connected to trays provided for this, in order to form a packaging lower part composed of different packaging materials for receiving a product, such as a food product, such as sausage, meat or cheese, provided along the downstream working stretch.

Multilayer packaging lower parts can then be produced along a packaging machine in a composite manner from tray parts made of different materials and they can have special packaging properties due to the use of different materials.

WO 2013/004837 A1 discloses a packaging machine wherein a transfer drum is used as a transfer element between a transport device and a film web to receive structural elements of the transport device and to place them beneath the film web. The transfer drum comprises a plurality of indentations at its surface, each of which can at least in part accommodate a structural element. The disadvantage of this is that the transfer drum takes up much space and transferring the trays is difficult to synchronize with the manufacturing process of the packaging machine.

WO 2017/001114 A1 also discloses a packaging machine having a suction unit for transferring structural elements to the packaging machine is used therein. The suction unit suctions the structural elements provided to it on a bottom inner side. The disadvantage of this is that, for transporting the deeply formed structural elements, the suction unit also has to be formed to reach deep down to the bottom inner side of the structural element in order to suction the structural element at the bottom inner side. As a result, the suction unit itself occupies much space, especially for the transport of different tray formats, and further requires additional costly construction measures at the packaging machine, in particular at other units functionally connected to the suction unit. For example, the work station configured to receive and process the structural elements must have a large opening width, for which costly lifting mechanisms are needed. Furthermore, there is the risk that the structural elements still provided in a specific format to the suction unit slightly move out of their predetermined position due to the suction process when being received at the suction unit, which can cause undesired production inaccuracies in a downstream processing step. For suctioning the base of the packaging, the latter must also have a certain flat surface suitable for being suctioned, which limits the packaging to certain packaging formats.

SUMMARY OF THE INVENTION

The object of the invention is to provide a packaging machine and a method for tray provision, with which an overall compact production process can be realized in a precise and versatile manner. Furthermore, the invention is to be distinguished from prior art by an increased cost-saving potential.

The packaging machine according to the invention, which may be preferably configured in the form of a thermoforming packaging machine, comprises a machine frame, at least one work station attached to the machine frame, for example a forming station for producing packing trays from film material, as well as a transport device with a transfer unit for supplying trays to the work station.

The trays supplied to the packaging machine have any randomly formed cup-shaped body and are made, in particular, of paper-like fibrous material, for example, made of cardboard, made of a metallic material, for example, made of aluminum, made of foamed material, for example, made of Styrofoam, made of two-component material and/or made of other material which may be suitable to form a packaging lower part in combination with film material. However, the trays transported are preferably cardboard trays.

According to the invention, the transfer unit comprises a suction plate for transporting trays in a predetermined transport plane. The suction plate may be extremely compact and can therefore be integrated into the machine frame of the packaging machine in a space-saving manner.

The suction plate further according to the invention comprises at least one reception mold which may be formed at least in part having the shape of an inner contour of an upper opening region of a tray facing it, provided to the reception mold for reception and transport, so that the reception mold during transport of the tray in the transport plane may be at least in part arranged in a positive-fit manner in its upper opening region and aligns the tray in the transport plane in a predetermined position on the suction plate.

It may be then possible to grip the provided trays only in their upper opening region, so that the suction plate can be formed to be compact throughout. It may be conceivable that the reception mold employed as a gripping device may be releasably attached as a removable component to the suction plate, so that the suction plate may be easily convertible with respect to different tray shapes In the invention, the reception mold of the suction plate may be preferably formed as a negative vacuum mold with respect to the upper opening region of respective trays. The reception mold can then overall immerse in a positive-fit manner into the complementarily formed upper opening region of a tray provided thereto, so that the tray can be precisely positioned on the suction plate, be transported onward in a compact manner, and be delivered precisely to the work station. Due to the positive-fit and compact tray reception, large accelerations are possible for the suction plate, so that the packaging process can overall be conducted in a time-optimized manner.

In particular, the work station intended for further tray processing also benefits from the suction plate, because the suction plate as a plate-shaped member can be brought together with the work station in such a way that short lifting strokes are possible. This provides the possibility of a compact and cost-reducing configuration of the packaging machine. Comparable advantages also arise for the transport units that are employed to provide the trays for reception at the suction plate. Overall, the suction plate may be therefore greatly suitable as a plate-shaped transfer device within a compact machine space for transport between other functional units provided therein.

The trays transported by way of the suction plate can preferably be suctioned onto the suction plate in the predetermined position by a vacuum applied to the suction plate. For this variant, the reception mold can be configured to suction the tray on at least two, preferably opposite, inner sides of side walls formed therein. In one variant, several reception molds, for example in a 2×2, 2×3 or 3×3 format, are formed on the vacuum plate in order to transport several trays in this format by way of the vacuum plate with every conveying cycle. Depending on a current transport format of the trays from the reception mold formed on the suction plate, only predetermined reception molds can be connected to the vacuum in an automated and/or manual manner.

One embodiment of the invention provides that the reception mold comprises at least one bore which rests on an inner wall surface of the upper opening region during transport in the transport plane of the tray placed on the reception mold in a positive-fit manner, so that a vacuum applied to the suction plate suctions the tray via the bore of the reception mold by way of a predetermined holding force to secure the tray in the predetermined position.

It would be conceivable that the vacuum applied to the suction plate may be variable in order to applying holding forces of different strengths. A preferred variant in this context could provide that the vacuum and therefore the holding force generated may be automatically and/or manually adapted at the packaging machine with respect to a weight of the tray to be transported.

One embodiment of the invention provides that the reception mold comprises several bores which are formed on at least two oppositely disposed side walls of the reception mold for suctioning corresponding inner sides of the tray. The suction surface can thus be increased overall, whereby positionally accurate holding of the tray may be possible. This can also result in advantages for other working steps and/or test steps occurring at the suction plate, which shall be explained in more detail below.

A preferred variant provides that at least one bore may be formed on all side walls of the reception mold, so that the tray can be suctioned by way of the reception mold on all inner sides of side walls formed thereon. This has proven to be particularly advantageous when transporting larger trays which are used, for example, for packaging larger food products, for example, heavy cheese or meat portions.

For the variants described above, different cross-sections of the bore can be considered for the respective suction bores. The bore can have, for example, a circular, slot-like, wave-shaped and/or zigzag-shaped suction surface for suctioning the tray at its inner wall region. It would even be conceivable that the bore may be formed as a circumferential suction opening in the circumferential direction on the reception mold for suctioning the tray all around on the inner side in its upper opening region.

The reception mold may be preferably formed as a centering member with respect to the upper opening region of the tray. This means that the reception mold at least in part forms a geometrically tapered negative mold, which fits into the upper opening region of the tray and can be inserted into the supplied trays such that the tray may be centered thereon, meaning, a slight lateral displacement of the tray relative to the reception mold may be compensated. In particular, even high process speeds can be achieved therewith because the reception mold configured as a centering member can be positioned at least in part in a self-locking manner in the upper opening region of the tray, so that an optimal positive-fit connection for their onward transport may be given.

Preferably, at least two opposite side walls of the reception mold at least in part comprise a slanted side wall surface. When inserting the reception mold into the upper opening region of the tray provided to the reception mold, the tray can therewith be precisely centered on the reception mold, while a possible slight lateral offset can be compensated.

To reduce weight, the reception mold can be configured as a hollow member. It would be conceivable for the suction plate to be configured to perform a working step on the received tray via a cavity created at the reception mold, for example, pretreating the volume formed by the tray and connected to the cavity with a fluid.

The suction plate preferably comprises a folding device which may be adapted to form a sealing flange on a tray arranged on the reception mold along a preferably pre-perforated edge of the upper opening region. This can be done in particular when the tray may be transported to the work station, so that the suction plate may be available both as a transport as well as a shaping module. The trays can therefore be supplied as semi-finished parts to the suction plate and be further formed thereat. The folding process can be performed without additional expense in time, i.e. during transport of the trays by way of the suction plate.

The reception mold may be preferably formed as part of the folding device. The reception mold therefore fulfills multiple functions at the suction plate according to the invention. The reception mold can preferably be used as a shaped abutment for the folding process, so that a precise sealing flange can be produced along the edge of the tray.

In particular, the suction plate can comprise an abutment edge along which the sealing flange can be folded. The abutment edge can there be formed on the suction plate such that it may be aligned for the folding process toward the pre-perforated edge of the tray, in other words, abuts thereagainst, so that a precise fold arises for the sealing flange.

One variant of the invention provides that the folding device has a forming plate on which the reception mold may be adjustably mounted. The forming plate may be placed primarily above the reception mold. The forming plate and the reception mold can be moved relative to one another by way of a lifting motion in such a way that they enable producing the sealing flange on the attached tray of the reception mold. The reception mold can be movably mounted in particular on the forming plate between a position extended for receiving the tray and a position retracted for performing the folding operation.

The folding device can preferably be formed as an exchangeable module, which may be exchangeably attached to the suction plate. According to one embodiment, the exchangeable module comprises four reception molds which are attached in a 2×2 format to the forming plate.

One advantageous embodiment may be that the reception mold may be formed retractable at least in part into the forming plate. For this purpose, the forming plate can comprise a receptacle into which the reception mold can enter at least in part for the folding process.

For an improved folding process, the forming plate can comprise a forming groove on the circumference of the reception mold into which sections of the edge formed on the tray for the production of the sealing flange are guided during the folding process, so that the folding process can be precisely controlled.

One variant provides that the reception mold may be mounted on the forming plate in a spring-loaded manner. Preferably at least one spring element may be provided between the forming plate and the reception mold to preload the reception mold to the extended position.

The folding device preferably comprises a movable lifting mechanism integrated into the suction plate. The lifting mechanism preferably comprises a controllable pressure element to move the reception mold for a folding operation toward the forming plate arranged thereabove. The tray placed on the reception mold can be pressed therewith against the forming plate for producing the sealing flange. The pressure element may be configured as an integral part of the suction plate and can be accommodated integrated therein, for example, as a controllable pressure diaphragm in order to coordinate the lifting motion of the reception mold relative to the forming plate.

The lifting mechanism preferably comprises at least one lifting element which may be mounted adjustable within the suction plate with the aid of the pressure element. According to the embodiment, the lifting element may be firmly coupled to the reception mold. The forming plate itself can be positioned as a rigid part of the suction plate between the reception mold arranged therebeneath and the lifting element arranged thereabove, wherein the pressure element in the pressure-loaded state against the forming plate therebeneath, lifts away therefrom the lifting element arranged thereabove, so that the reception mold positioned on a side of the forming plate facing away from the pressure element may be adjusted toward to the forming plate for performing a folding process.

The lifting mechanism of the folding device may be preferably configured as a frame module which may be adjustably mounted movable on the suction plate relative to the forming plate positioned therebetween for performing the folding operation.

The suction plate can be equipped with at least one dynamic pressure test unit. It can be used to verify whether a tray may be properly placed onto the reception mold and/or whether a sealing flange has been properly formed on the tray. The dynamic pressure test unit may be formed preferably at least in part on the forming plate for checking the abutment of the tray, in particular its sealing flange.

According to one variant, the reception mold can be formed to be actively heated so that trays placed thereon are pretreated with heat at least in sections so that they can be better connected to another tray material, for example, a packaging film, in a downstream process. It would be conceivable to control the temperature by way of electromagnetic heating at the reception mold.

The suction plate preferably has a maximum installation height of 50 cm, preferably 30 cm, more preferably 10 cm. In such a compact plate-shaped installation configuration, it can be easily received and moved within the machine frame of the packaging machine.

The suction plate may be preferably mounted adjustable by way of a linear drive in or opposite to a working direction of the packaging machine between a receiving position, in which trays can be transferred to the suction plate, and a transfer position, in which trays transported by the suction plate can be transferred to the workstation. The linear drive may be configured, in particular, for horizontal adjustment of the suction plate along the machine frame The Linear drive preferably comprises a guide oriented in the working direction of the packaging machine on the machine frame and a carriage that may be displaceably mounted thereon and to which the suction plate may be attached. The suction plate can therewith be precisely adjusted to and fro at a predetermined height level. As a gripper positioned within the machine frame, the suction plate can therefore ensure tray delivery to the work station.

Viewed in the working direction, the suction plate can be positioned upstream or laterally relative to the work station to be supplied with trays.

The invention further relates to a method for tray provision at a packaging machine which may be present in particular in the form of a thermoforming packaging machine The method according to the invention for supplying trays to a work station of the packaging machine may be characterized in that a suction plate with a reception mold arranged thereon, which may be formed at least in part having the shape of an inner contour of an upper opening region of a tray facing it, provided to the reception mold for reception and transport, engages during transport in a transport plane least in part in a positive-fit manner in the upper opening region of a tray transferred to the reception mold and aligns the tray in the transport plane in a predetermined position on the suction plate.

With the method according to the invention, the reception mold formed on the suction plate can be formed as a positive-fitting negative mold in terms of the upper opening region of the tray provided in order to immerse thereinto in a complementary manner.

When the tray may be transported by way of the suction plate, preferably a vacuum applied to the suction plate via at least one bore of the reception mold suctions the tray at the upper opening region on the inner wall surface thereof by way of a predetermined holding force in order to secure the tray in the predetermined position.

One variant provides that a sealing flange on a tray positioned on the reception mold may be folded over by way of an adjustable folding device of the suction plate along a preferably pre-perforated edge of the upper opening region. Since this occurs in a preferred manner during the transport of the tray, a separate forming process can be dispensed with, so that the manufacturing process can overall be conducted in a time-optimized manner.

The folding process for producing the sealing flange on the suction plate may be preferably controlled by way of a pressurized lifting mechanism of the folding device integrated on the suction plate.

Verifying the presence of a tray on the reception mold and/or the proper production of a sealing flange on the tray can be done by way of at least one dynamic pressure test unit provided on the suction plate. It can be determined there from the presence of a predetermined dynamic pressure applied to the tray that the tray may be received in the predetermined position on the suction plate for transport and/or that the sealing flange produced by way of the folding device has been formed within tolerance limits.

The suction plate may be preferably used as a vacuum gripper, with which trays are cyclically transported in or opposite to a working direction of the packaging machine from a receiving position in which the trays are transferred to the suction plate, to a transfer position in which the trays are transferred from the suction plate to the work station. Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
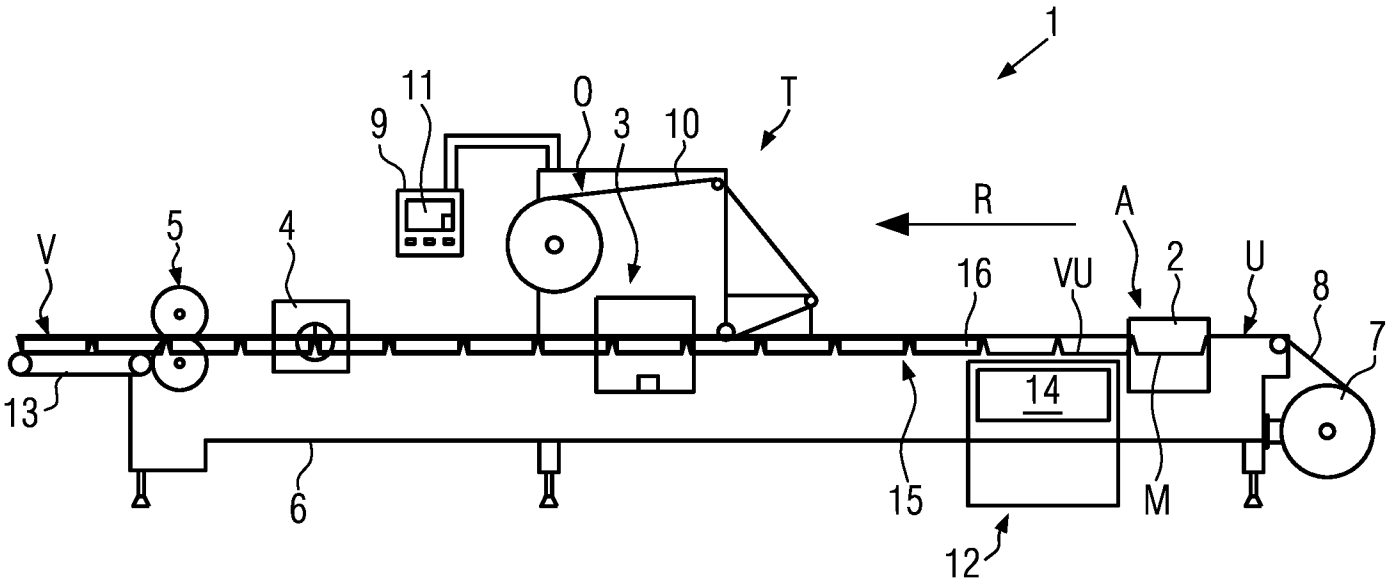
FIG. 1 is a schematic side view of one embodiment of a packaging machine in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention may be defined by the appended claims and the description is, therefore, not to be taken in a limiting sense and shall not limit the scope of equivalents to which such claims are entitled.

FIG. 1 shows a schematic view of a packaging machine 1 embodied in the form of a thermoforming packaging machine T. Packaging machine 1 comprises a work station A formed as a forming station 2, a sealing station 3, a transverse cutting device 4 as well as a longitudinal cutting device 5. They are arranged in this order along a working direction R on a machine frame 6.

Attached to machine frame 6 of packaging machine 1 on the inlet side is a feed roller 7 from which a base film U as lower packaging material 8 is withdrawn. Base film U is transported by way of an advance device, not shown, into forming station 2. Two packaging trays M are formed into base film U using forming station 2 by way of a thermoforming process taking place there. Packaging trays M can be transported onward to a loading stretch 15 where they can be filled manually or automatically with a product 16. Downstream of loading stretch 15, packaging trays M filled with products 16 are transported onward to a sealing station 3. Packaging trays M can be sealed by sealing station 3 with a top film O which forms an upper packaging material 10, so that sealing top film O onto packaging trays M produces sealed packagings V which are separated by way of transverse cutting device 4 and longitudinal cutting device 5 and can be transported away using a discharge device 13.

Furthermore, packaging machine 1 shown in FIG. 1 comprises a controls terminal 9 at which process parameters can be set for the respective work stations provided at packaging machine 1. Controls terminal 9 comprises a control unit 11 which is shown only schematically. Control unit 11 is configured to perform computing operations, in particular in real time during the production process, in order to control packaging machine 1 based on processes, i.e. to possibly have respective process parameters of packaging machine 1 adjusted in relation to the process.

Packaging machine 1 illustrated in FIG. 1 furthermore comprises a transport device 12 with a transfer unit 14 which is associated with workstation A and with which trays supplied from outside packaging machine 1 can be received within machine frame 6, transported onward and be transferred to forming station 2 positioned in the image plane of FIG. 1 upstream adjacent thereto. Transport device 12 could there alternatively be positioned in working direction R, in particular, also upstream of forming station 2. Transport device 12 is configured to continuously supply trays to forming station 2 during the manufacturing process which are combined with packaging trays M produced therein to create a (composite) packaging lower part VU.

Figure 2:
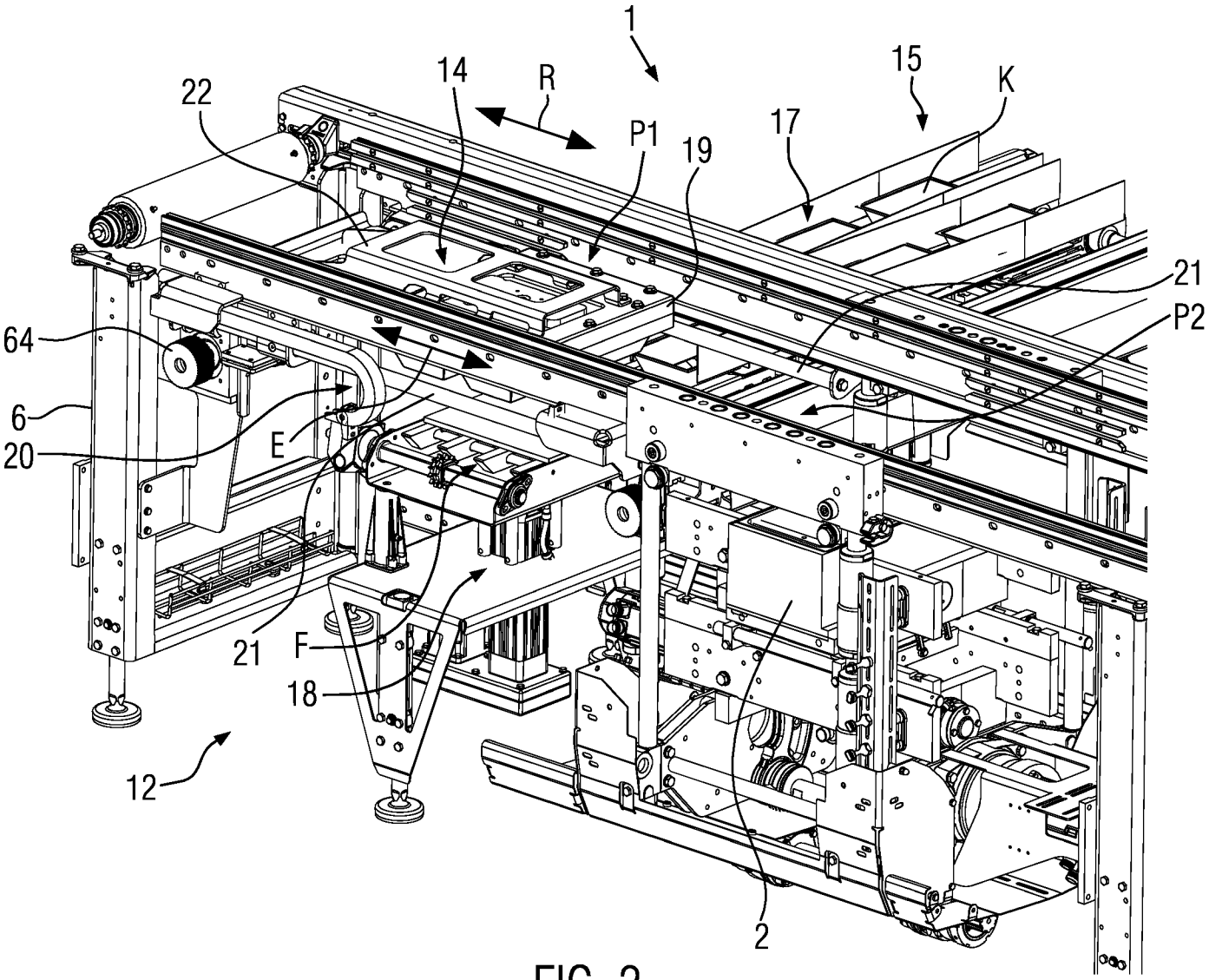
FIG. 2 is a perspective view of one embodiment of a packaging machine in accordance with the teachings of the present disclosure, that shows the suction plate employed for the transport of trays.

FIG. 2 shows a perspective view of transport device 12 integrated into machine frame 6 of packaging machine 1. According to FIG. 2, transport device 12 is transferred a plurality of trays 17 in a predetermined format F by feeding device 15, presently in a 2×2 format, from outside machine frame 6 of packaging machine 1. Trays 17 in FIG. 2 are formed as cardboard trays K, but can also be made of a different material.

According to FIG. 2, trays 17 are transferred in the predetermined format F to a lifting mechanism 18 of transport device 12 mounted vertically adjustable along lifting direction C within machine frame 6. Lifting mechanism 18 is adapted to lift trays 17 positioned thereon for transferring trays 17 to transfer unit 14 positioned thereabove in a receiving position P1. The transfer unit 14 shown in FIG. 2 is adjustably mounted in or against the working direction R of the packaging machine 1 between the receiving position P1, in which the trays 17 can be transferred thereto, and a transfer position P2 along a transport plane E, in which trays 17 transported by the transfer unit 14 can be transferred to the forming station 2.

According to FIG. 2, transfer unit 14 is configured as a suction plate 19. Suction plate 19 is mounted adjustable between receiving position P1 and transfer position P2 by a linear drive 20 in or opposite to working direction R of packaging machine 1. Linear drive 20 is equipped with a guide 21 oriented in working direction R of packaging machine 1 on machine frame 6 and a carriage 22 that is displaceably mounted thereon and to which suction plate 19 is attached Furthermore, an electric motor 64, for example, a servo motor, adapted to control an adjustment motion of suction plate 19 is preferably attached to machine frame 6. The operation of electric motor 64 can be coordinated by control unit 11 of packaging machine 1.

The configuration shown in FIG. 2 shows that suction plate 19 as such is moved to and fro only horizontally in transport plane E for continuously supplying trays 17 received thereon to forming station 2 for further processing with packaging recesses M formed thereon.

Figure 3:
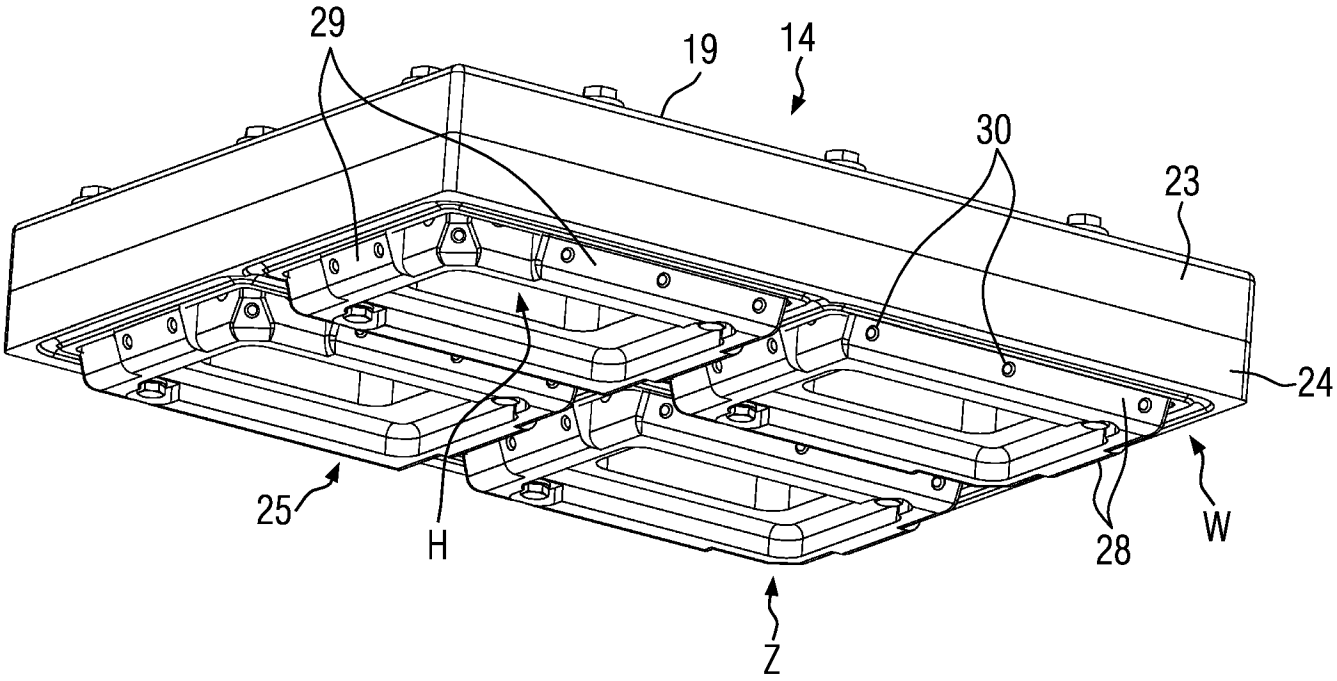
FIG. 3 is a perspective view of one embodiment of a suction plate in accordance with the teachings of the present disclosure in an isolated view.

FIG. 3 shows suction plate 19 according to one variant in an isolated view. Suction plate 19 shown in FIG. 3 comprises a plate-shaped upper part 23 with which suction plate 19 can be attached to carriage 22 (see FIG. 2). Furthermore, suction plate 19 comprises a plate-shaped center part 24 which is connected to upper part 23. Several reception molds 25 extend from center part 24 on a side facing away from upper part 23. Reception molds 25 are shaped in such a way that, with regard to trays 17 that are provided to them for transport, they can at least in part receive them as a negative mold in a positive-fit manner in their upper opening region 26.

Reception molds 25 can each be available separately or coupled to center part 24 as an exchange or retrofit attachment W for suction plate 19 in order to convert suction plate 19 for flexible use with respect to different tray geometries. Reception molds 25 shown in FIG. 3 are each configured as hollow bodies H in particular for reducing the weight of suction plate 19.

Figure 4:
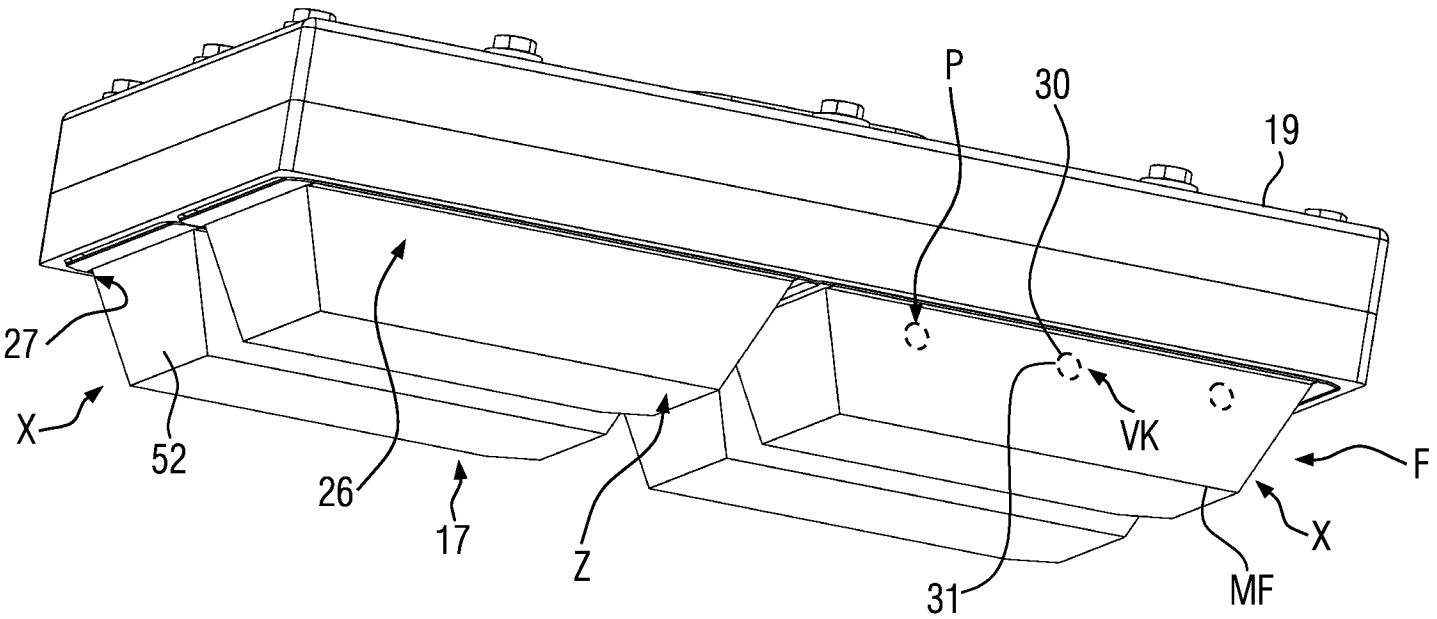
FIG. 4 is a perspective view of the suction plate according to the embodiment of FIG. 3 showing a plurality of trays positioned thereon.

FIG. 4 shows suction plate 19 from FIG. 3 with trays 17 received thereon in predetermined position X. According to FIG. 4, trays 17 received each have a bowl-like trough shape MF with an upper opening region 26 into which respective reception molds 25 immerse in a positive-fit manner.

Figure 7:
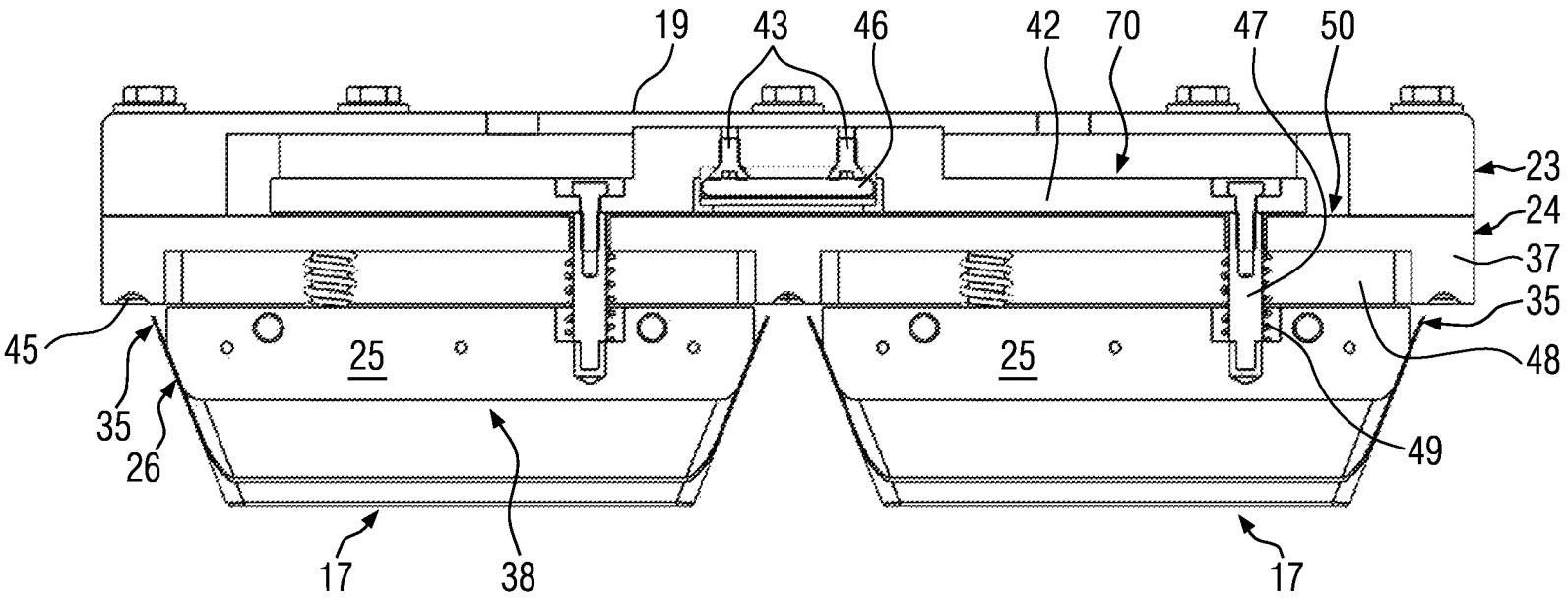
FIG. 7 is an end view of an embodiment of the suction plate in accordance with the present disclosure showing a folding device and a plurality of trays positioned thereon having an un-bent edge region.
Figure 8:
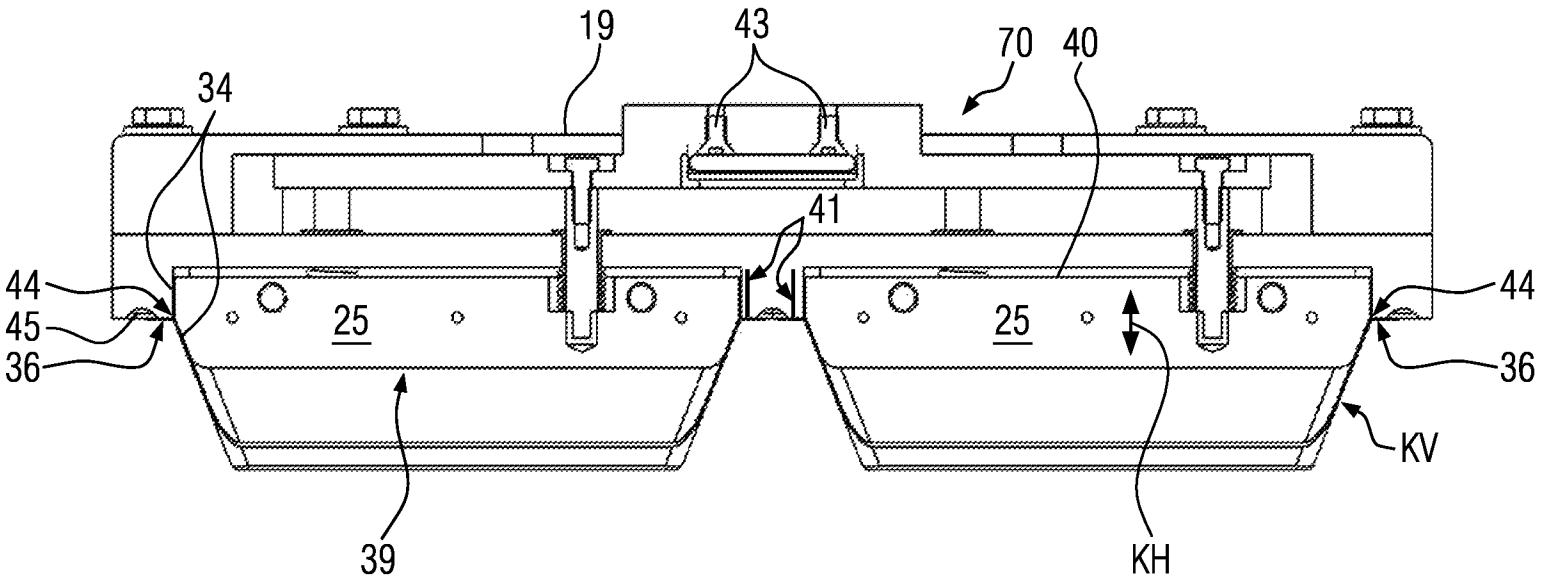
FIG. 8 is an end view the suction plate from FIG. 7 with trays positioned thereon having the edge bent.

Upper opening regions 26 formed on respective trays 17 have an inner contour 27 which corresponds at least substantially to the formation of respective side walls 28 (see FIG. 3) of reception molds 25. According to FIG. 3, respective side walls 28 of reception molds 25 (see FIG. 2), which are oriented towards the side of machine frame 6, are slanted so that they have a slanted suction surface 29. Reception molds 25 are configured according to FIG. 3 and FIG. 4, in particular, as centering members Z, in order to possibly compensate for a slight offset of supplied trays 17 when they are received at suction plate 19. Reception molds 25 designed in particular as centering members Z aim to ensure that trays 17 placed thereonto can be received in a precise position on suction plate 19, so that further work steps, for example, a folding operation KV described in the context of FIG. 7 and FIG. 8, are promoted apart from the actual transport purpose.

Furthermore, FIG. 3 shows that bores 30 are formed along respective side walls 28 of reception molds 25. During transport of trays 17 which are attached in a positive-fit manner on reception molds 25, respective bores 30 abut in sections against the former's inner wall surface 31 of upper opening region 26, so that a vacuum VK applied to suction plate 19 via bores 30 of respective reception mold 25 suctions tray 17 attached thereto by way of a predetermined holding force P in order to align trays 17 in a predetermined position X on suction plate 19, i.e. to transport them in the predetermined format F and transfer them to forming station.

FIG. 4 also shows that respective trays 17 are received by suction plate 19 both in a positive-fit as well as in a force-fit manner. The positive-fit engagement is achieved by way of reception molds 25 produced as negative vacuum molds. The force-fit engagement for transporting trays 17 is supplied by vacuum VK applied to the respective inner wall surface 31 of trays 17.

Figure 5:
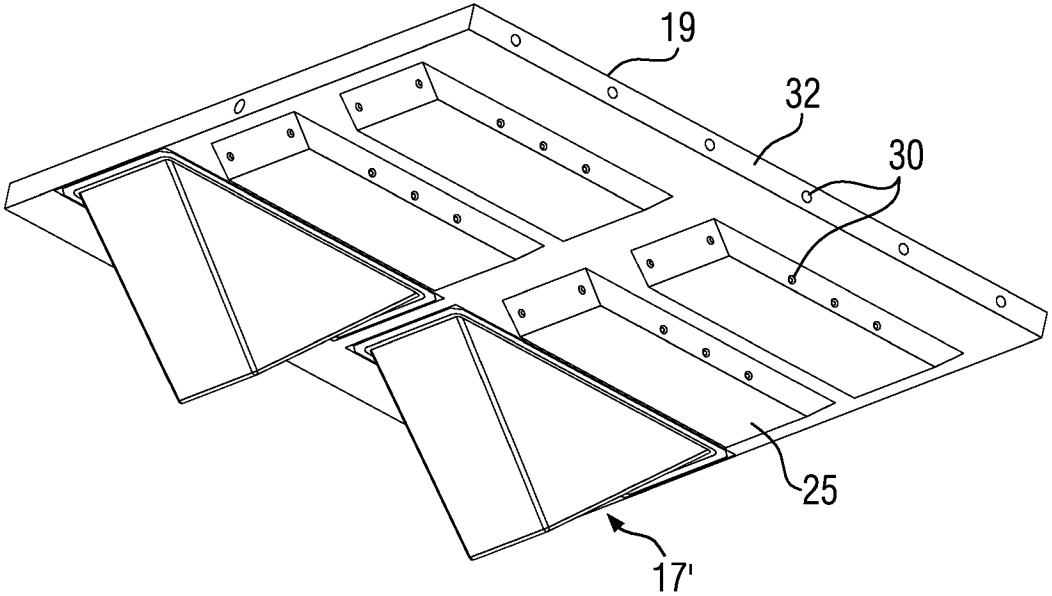
FIG. 5 is a perspective view of another embodiment of a suction plate in accordance with the teachings of the present disclosure in an isolated view.

FIG. 5 shows suction plate 19 according to another variant for transporting a format F of trays 17' that is different than is shown by way of suction plate 19 described in the context of the previous figures.

According to FIG. 5, a total of nine wedge-shaped trays 17', which can be used, for example, for packing triangular slices, can be received at suction plate 19. Trays 17' are there transported by way of suction plate 19 in a 3×3 format.

The technical principle, according to which trays 17' can be secured to suction plate 19 both by positive-fit engagement at their upper opening region 26 and by force-fit engagement based on vacuum VK applied in this region, is also given in FIG. 5.

Formed in suction plate 19 of FIG. 5 is a plurality of bores 30 in a plate member 32 as well as in respective reception molds 25 to distribute vacuum VK applied to suction plate 19 for evenly securing trays 17'.

Figure 6:
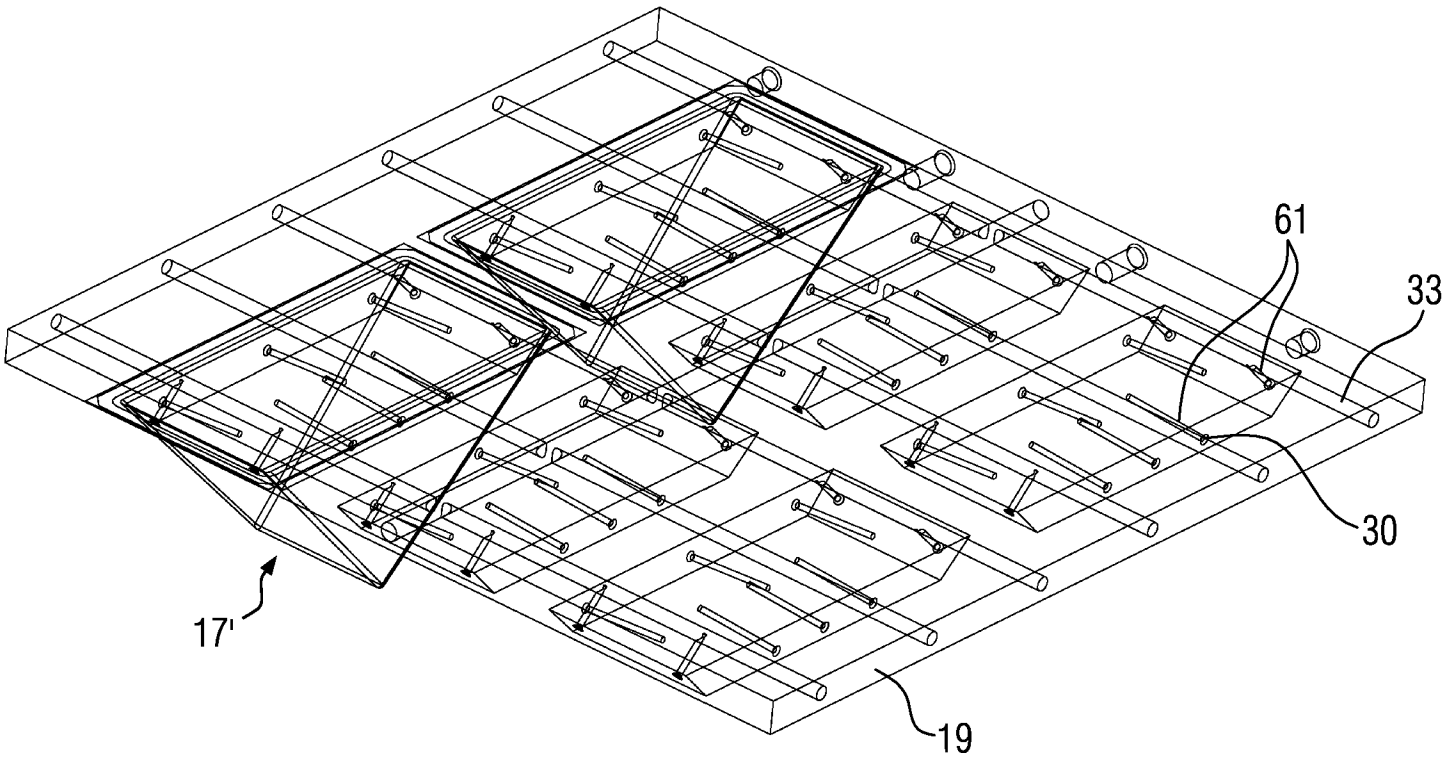
FIG. 6 is a top perspective view of the suction plate of FIG. 5 showing the configuration in a transparent manner with trays positioned thereon.

FIG. 6 shows several connection channels 33 formed in plate part 32 of suction plate 19 and respective connections 61 which deliver vacuum VK generated at suction plate 19 all the way to bores 30 formed on side walls 28 of reception molds 25. Vacuum VK applied via the respective connection channels 33 and/or connections 61 can be selectively directed and blocked at individual reception molds 25 by way of suitable valve control.

FIG. 7 shows suction plate 19 with folding device 34 formed integrally thereon. Folding device 34 comprises an adjustably mounted lifting mechanism 70 integrated into suction plate 19. Lifting mechanism 70 comprises a lifting element 42, for example, in the form of a plate which is arranged movable inside upper part 23 formed to be hollow in part, and a pressure element 43 arranged therebelow which is present in particular in the form of an inflatable membrane 46.

Lifting element 42 is connected by way of connection pins 47 to reception molds 25. Connection pins 47 pass through a forming plate 37 of folding device 34 embodied for a folding operation or process KV (see FIG. 8). Lifting element 42, which is positioned above forming plate 37, and reception molds 25, which are attached to lifting element 42 by way of connection pins 47 and positioned on a side of forming plate 37 facing away, form a functionally coherent module of folding device 34.

In the pressure-loaded state, membrane 46 raises lifting element 42 upwardly away from forming plate 37. As a result, reception molds 25 coupled thereto for folding operation or process KV are raised at the same time for producing a sealing flange 36 (see FIG. 8) on trays 17 placed thereon. In the unpressurized state, lifting element 42 rests on an upper side 50 of forming plate 37. Reception molds 25 are accordingly in an extended position 38 shown in FIG. 7. In this position 38, reception molds 25 are positioned in a spring-loaded manner by way of respective spring elements 49. The jointly acting spring rate of respective spring elements 49 can be matched to the pressure-loaded operation of membrane 46 in such a way that a predetermined folding stroke KH indicated in FIG. 8 is obtained.

According to FIG. 7 and FIG. 8, sealing flange 36 is formed for respective trays 17, which are arranged on reception molds 25, along an edge 35 of respective upper opening region 26 formed thereon.

For the production of respective sealing flanges 36, reception molds 25 can be at least in part retracted at forming plate 37 disposed thereabove into receptacles 48 formed thereon in order to draw trays 17 arranged thereon toward forming plate 37.

FIG. 8 shows that trays 17 arranged on reception molds 25 are deformed along their edge 35 by folding stroke KH, as a result of which sealing flange 36 is formed on respective trays 17.

Suction plate 19 shown in FIG. 7 holds reception molds 25 arranged thereon in a spring-loaded manner in extended position 38, in which trays 17 are transferred without sealing flange 36 formed thereon to suction plate 19. FIG. 8 shows respective reception molds 25 in a retracted position 39, in which reception molds 25 are drawn into corresponding receptacles 48 of forming plate 37 disposed thereabove by way of lifting mechanism 70 which is now pressure-loaded against the spring preload. By immersing respective reception molds 25 into receptacles 48 of forming plate 37 provided for this purpose, folded edge 35 shown in FIG. 7 is deformed in such a way that respective sealing flanges 36 shown in FIG. 8 are produced on trays 17.

According to FIG. 7 and FIG. 8, bending grooves 45 are formed on forming plate 37 adjacent to respective receptacles 48 and support the folding operation or process KV of sealing flanges 36. A circumferential abutment edge 44 formed at respective receptacles 48 also has a positive effect on the creation of a precise sealing flange 36.

Furthermore, FIGS. 7 and 8 show that suction plate 19 shown therein also comprises a dynamic pressure test unit 41. Dynamic pressure test unit 41 is formed on forming plate 37 in such a way that it can be verified in particular whether a tray 17 is properly positioned on suction plate 19 for a transfer process to work station A. It can also be verified by way of the dynamic pressure test unit 41 whether sealing flange 36 has been folded within tolerance limits.

Transport device 12 employed in the invention, including suction plate 19 employed according to the invention, can be used at different locations along packaging machine 1 for supplying respective trays 17 that are fed to packaging machine 1 from outside for a further processing process performed there, for example, for combining with packaging trays M thermoformed at forming station 2. In particular, transport device 12 can be positioned, when viewed in working direction R of packaging machine 1 of FIG. 1, upstream or downstream of forming station 2 configured as work station A, for manufacturing trays 17 corresponding to packaging trays M produced there for producing packaging lower parts VU combined from trays 17 and packaging trays M. (see FIG. 1). Respective packaging lower parts VU produced in forming station 2 are then transported onward quasi as a tray composite to loading stretch 15.

Transport device 12 used in the invention is not restricted to the use at a thermoforming packaging machine T according to FIG. 1, but can also be used in an advantageous manner at other types of machines, such as tray sealers.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine comprising:

a machine frame;

a work station attached to said machine frame; and a transport device with a transfer unit for supplying trays to said work station;

wherein said transfer unit comprises a suction plate for transporting trays in a predetermined transport plane; and wherein said suction plate comprises a reception mold that is formed at least in part having a shape of an inner contour of an upper opening region of a tray positionable opposite of said suction plate on said transfer unit, wherein said reception mold is configured to receive and transport said tray so that said reception mold during transport in the transport plane of said tray is arranged in a positive-fit manner in said upper opening region of said tray and said reception mold aligns said tray in said transport plane in a predetermined position on said suction plate;

wherein said reception mold is configured to suction said tray on an inner side of at least two different side walls of said tray; and wherein said reception mold comprises at least one sidewall and at least one bore disposed on said at least one sidewall to align with an inner wall surface of said upper opening region of said tray during transport of said tray when placed on said reception mold in a positive-fit manner, so that a vacuum applied to said suction plate through said at least one bore suctions said tray to apply a predetermined holding force to secure said tray in said predetermined position.

2. The packaging machine according to claim 1, wherein said reception mold has at least two opposing sidewalls and a plurality of bores disposed on each of said at least two opposing sidewalls of said reception mold for suctioning at least two opposing inner sides of said tray.

3. The packaging machine according to claim 1, wherein the reception mold comprises a plurality of sidewalls and said tray comprises a plurality of sidewalls, and each of said sidewalls of the reception mold includes at least one bore so that said reception mold can suction each sidewall of said tray on each inner side of said plurality of side walls of said tray.

4. The packaging machine according to claim 1, wherein said reception mold is formed as a centering member with respect to said upper opening region of said tray.

5. The packaging machine according to claim 4, wherein said reception mold comprises at least two opposing side walls and wherein at least a portion of each of said opposing sidewalls includes a slanted suction surface.

6. The packaging machine according to claim 1, wherein said suction plate comprises a folding device which is configured to form a sealing flange on said tray when said tray is arranged on said reception mold.

7. The packaging machine according to claim 6, wherein said reception mold is formed as part of said folding device.

8. The packaging machine according to claim 7, wherein said folding device comprises a forming plate on which said reception mold is adjustably mounted.

9. The packaging machine according to claim 8, wherein said reception mold is retractable at least in part into said forming plate.

10. The packaging machine according to claim 8, wherein said suction plate comprises a pressure element configured to move said reception mold toward said forming plate for a folding process.

11. The packaging machine according to claim 1, wherein said suction plate comprises a dynamic pressure test unit.

12. The packaging machine according to claim 1, wherein said suction plate is adjustably mounted with a linear drive configured to adjust a position of said suction plate in a direction in or opposite to a working direction of said packaging machine between a receiving position, in which trays can be transferred to said suction plate, and a transfer position, in which trays transported by said suction plate can be transferred to said workstation.

13. The packaging machine according to claim 12, wherein said linear drive comprises a guide oriented in said working direction of said packaging machine on said machine frame and a carriage that is adjustably mounted thereon and to which said suction plate is attached.

14. The packaging machine according to claim 1, wherein said suction plate comprises an upper part, a lifting plate movably arranged inside said upper part and connected to said reception mold, a controllable pressure diaphragm configured to raise said lifting plate, and a forming plate positioned between said lifting plate and said reception mold, and wherein said pressure diaphragm is operable to raise said lifting plate upwardly away from said forming plate to thereby raise said reception mold when said tray is on said reception mold so that an upper end of said tray is foldable against said forming plate to form a sealing flange on said tray.

15. The packaging machine according to claim 14, wherein said forming plate defines a receptacle configured to receive said reception mold when said lifting plate and said reception mold are raised.

16. A method for supplying trays to a work station of a packaging machine, the method comprising:

providing a suction plate with a reception mold arranged thereon, wherein the reception mold is formed at least in part having a shape of an inner contour of an upper opening region of a tray being used in the packaging machine;

engaging the tray in the upper opening region of the tray with the reception mold at least in part in a positive-fit manner during transport of the tray in a transport plane of the tray;

aligning the tray in a predetermined position on the suction plate in the transport plane; and applying a vacuum to the suction plate through at least one bore disposed on at least one side wall of the reception mold to apply a predetermined holding force on the tray on at least one inner wall surface of the tray to secure the tray in the predetermined position.

17. The method according to claim 16, further comprising the step of folding over a sealing flange on the tray, along a pre-perforated edge of the upper opening region of the tray, when the tray is positioned in an aligned manner on the reception mold using a folding device of the suction plate.

18. The method according to claim 16, further comprising the steps of applying a dynamic pressure to the tray and checking the dynamic pressure applied to the tray using a dynamic pressure test unit provided on the suction plate.

19. The method according to claim 16, wherein the suction plate is a vacuum gripper, and further comprising the steps of transporting a plurality of the trays in or opposite to a working direction of the packaging machine from a receiving position, in which the trays are transferred to the suction plate, to a transfer position, in which the trays are transferred from the suction plate to the work station.

20. The method according to claim 16, wherein the suction plate comprises an upper part, a lifting plate movably arranged inside the upper part and connected to the reception mold, and a forming plate positioned between the lifting plate and the reception mold, and the method further comprises moving the lifting plate upwardly away from the forming plate to thereby raise the reception mold when the tray is on the reception mold so that an upper end of the tray is folded against the forming plate to form a sealing flange on the tray.

* * * * *